US007581897B2

(12) United States Patent
Caserta et al.

(10) Patent No.: US 7,581,897 B2
(45) Date of Patent: Sep. 1, 2009

(54) DEVICE FOR THE CARE OF FOOTWEAR

(75) Inventors: Andrea Caserta, Barcelona (ES); Julio Cesar Ruiz Ballesteros, Barcelona (ES); Jose Antonio Munoz Martinez, Barcelona (ES); David Moreno Perez, Barcelona (ES); Xavier Alvarez Leal, Barcelona (ES); Fernando Mayor Sans, Barcelona (ES)

(73) Assignee: Zobele Espana S.A. (ES)

( * ) Notice: Subject to any disclaimer, the term of this patent is extended or adjusted under 35 U.S.C. 154(b) by 703 days.

(21) Appl. No.: 11/238,205

(22) Filed: Sep. 29, 2005

(65) Prior Publication Data

US 2007/0071533 A1 Mar. 29, 2007

(51) Int. Cl.
*A46B 11/00* (2006.01)

(52) U.S. Cl. ..... 401/125; 401/5; 401/123; 401/124; 401/191

(58) Field of Classification Search ..... 401/5, 401/119, 123, 125, 126, 130, 131, 191, 118, 401/127, 147, 208, 209
See application file for complete search history.

(56) References Cited

U.S. PATENT DOCUMENTS

| | | | | |
|---|---|---|---|---|
| 4,168,128 | A * | 9/1979 | Fillmore et al. | 401/213 |
| 5,865,554 | A * | 2/1999 | Lin | 401/206 |
| 6,224,286 | B1 | 5/2001 | Villahoz | 401/219 |
| 6,499,898 | B1 * | 12/2002 | Garcia | 401/130 |
| 6,634,821 | B2 * | 10/2003 | Gueret | 401/126 |
| 7,188,385 | B2 * | 3/2007 | Fritz | 15/111 |
| 2004/0052568 | A1 * | 3/2004 | Gueret | 401/124 |
| 2005/0254880 | A1 * | 11/2005 | Brajdic et al. | 401/130 |
| 2007/0077113 | A1 * | 4/2007 | Nanda | 401/39 |

FOREIGN PATENT DOCUMENTS

| | | |
|---|---|---|
| ES | 134686 | 12/1967 |
| ES | 1 006 298 | 12/1988 |
| ES | 1 038 111 | 5/1998 |
| ES | 2 165 273 | 3/2002 |

* cited by examiner

*Primary Examiner*—David J. Walczak
*Assistant Examiner*—Ryan Varnum
(74) *Attorney, Agent, or Firm*—Ostrolenk Faber LLP

(57) ABSTRACT

The device comprises an applicator (2) and a cover (5) configured to be adaptable on the applicator (2), the external face (3) of which is impregnated with conditioning substance for shoes by rolling dispenser means (10) incorporated in the internal face (9) of the cover (5), which includes a reservoir (4) with such substance. The substance dosing is produced on opening the device, the applicator (2) sliding, via some guides (8) arranged on the lateral face (7) of the cover (5), over the dispenser means (10) which apply an optimum quantity of substance to the external face (3) of the applicator (2), with which the footwear is subsequently rubbed to clean it. When used, the device is closed by transversely coupling the applicator (2) inside the cover (5), preferably of plastic with transparent reservoir (4). For convenience, the device can incorporate an ergonomic handle (1) joined to the applicator (2).

15 Claims, 4 Drawing Sheets

DEVICE FOR THE CARE OF FOOTWEAR

OBJECT OF THE INVENTION

The present invention has its application in the industrial sector engaged in the production of products for the treatment or care of shoes.

The invention described hereunder relates to a device for the care of footwear which is constituted based on an applicator of shoe-conditioning substance, fittable inside a cover where a reservoir is mounted holding the cleaning, dying or polishing substance, distributed through some dispenser means foreseen in the same cover directly onto the face of the applicator with which the shoe is rubbed, dosing the right substance in the moment when the device is opened.

An object of the invention is to allow the shoes to be cleaned meticulously, without suffering excesses in the application of the substance when transferring it to the surface of the footwear.

It is also an object of the invention to allow use of the device to be simple, applying ergonomics thereto for its handling by the user and a configuration adapted to any shoe for cleaning whatsoever area of its surface comfortably.

BACKGROUND OF THE INVENTION

At the present time, a multitude of devices are known for cleaning and polishing shoes which basically comprise a reservoir of a footwear conditioning substance, usually silicone or polish, which is applied to the interior of a sponge with which the user shines the surface of his shoes.

The applicator sponge, usually made of polyurethane, can be incorporated in a cover included in the shoe-cleaning device and directly impregnated with the polishing or dying substance of the shoes, as is the case of the container employed for this function, among others, which is described in the Utility Model Application ES 1038111 U.

In other cases, like those described in the Utility Model ES 0134686 U and the application ES 1006298 U, the sponge for application of the liquid substance is in the mouthpiece of the shoe-cleaning container. The silicone or the polish have access to the sponge through a valve which acts as dispenser means, but without obtaining an effective dosing of the substance. The disposition of the liquid is usually produced on the inside of the sponge and takes place during the shoe-cleaning operation which the user is carrying out, due to the pressure applied to the sponge itself, or, because the actual user presses manually on the area of the reservoir of polishing or dying substance.

This mechanism for application of the liquid on the surface of the shoe is relatively imprecise regarding the quantity of silicone or polish released from the reservoir to the sponge. Frequently it happens that, since the user can have no knowledge of the quantity of substance that is being dispensed, an excessive application is produced and this is not realized until the liquid reaches the surface of the sponge and is distributed over the shoe, in larger doses than those really necessary. At this point, the user discovers he has allowed too much liquid to flow into the sponge, due to the delay between the egress of the substance from the reservoir until it is observed on the surface of the shoe. In consequence, the shoe is drenched and the user is compelled to remove the surplus with a dry cloth.

In a word, this type of device is therefore generally very dirty in its application. Another problem resulting from this characteristic is that in such devices it is necessary to include a cover to avoid leakage or spillage of the liquid during its storage and it is recommended to locate them in a position stable in itself.

In the search for a solution to these problems, there are applicator devices of liquid or cream for cleaning footwear which incorporate a ball-shaped spongy element which acts in a roll-on fashion in order to achieve a completely uniform impregnation of the substance into the applicator and onto the shoe. A shoe cleaner of this kind, which is also fitted with sealing means with which the egress or not of liquid can be controlled, independently of the container being inclined on the shoe, is contemplated in the Patent of Invention ES 2165273.

As for the applicator element of the liquid, manufactured in sponge or foam, the presence is not known among the cleaning devices currently on the market of said applicator configured with a geometry such that it allows one to reach easily any area on the surface of the footwear which it is desired to clean, for which reason there are sometimes nooks and pleats in the shoe, according to the design thereof, which remain impossible to clean/dye/polish.

The majority of shoe cleaners have poor ergonomics as regards their manipulation when cleaning and polishing footwear, which combines with the aforesaid drawback concerning the user having no indicator on the device to inform him of the quantity of substance to be dispensed or that is still remaining to be applied. Clearly this last feature is possible in the classic products for cleaning shoes wherein the user must apply the cream or polish himself by means of a cloth, but not in the current devices of instantaneous application by impregnated sponge or foam, like the types which have been mentioned up to here.

Notwithstanding, it is known that there are some products in which it is indicated whether the reservoir of conditioning substance is empty, but this "end of use" indicator is fictitious because there is surely still some substance remaining outside the reservoir, in the dispensing valve or impregnating the applicator sponge.

DESCRIPTION OF THE INVENTION

The present invention manages to resolve, among others, the problem explained above, in all of the different aspects explained in the background.

Specifically, the invention relates to a device for the care or treatment of footwear, cleaner, polisher, dyer or conditioner of shoes, which comprises an applicator of material suitable for receiving and applying a conditioning substance on the surface of a shoe, the device being in addition fitted with a cover adapted in form and dimensions to the profile of the applicator to be adaptable to the same. Optionally, the device can additionally comprise a handle joined by its base to the applicator.

The main characteristics distinguishing the invention from the known precedents reside fundamentally in said cover. On one hand, the substance which is used for the care of the shoes is contained in a reservoir located in the actual cover of the device. In addition, the cover houses in its interior, dispenser means of such substance which are impregnated and apply it directly on the face of the applicator which is put into contact with the surface of the footwear to be cleaned.

The conditioning substance reservoir incorporated in the cover or at least part of the said reservoir is transparent, to be able to appreciate the end of use, that is, in order to allow the quantity of conditioning substance remaining in said reservoir to be seen. This indication of the end of use is real, since when the substance of the reservoir is finished, there is no trace of substance in the applicator either, since the latter is only impregnated when said applicator acts directly on the dispenser means included in the reservoir and if there is nothing therein, it is certain that no substance remains to apply.

The device can be used on a once-only basis, that is, when the substance is finished, it can be disposed of. But the reservoir can also be accessible to load it with more conditioning substance. The substance replacements, the reservoir and the cover can be acquired by the consumer separately from the device itself for the reloading thereof.

The application of said substance in the applicator of the device is done with the same opening movement, which is carried out by pulling the applicator, by means of the handle, in a direction longitudinal to the cover in order to extract it from its interior. The handle can be of ergonomic design to facilitate the handling of the device, for opening it, closing it and during the task of cleaning the footwear for which it is conceived. On the upper part of its side face, the cover has some guides whereon the peripheral edge of the base of the handle is coupled and they allow that longitudinal displacement of the applicator, with which it passes sliding over the internal face of said cover.

Due to the friction and pressure between the external face of the applicator, with which face the surface of the footwear to be cleaned is subsequently rubbed, and the internal face of the cover, the dispenser means act to coat the aforementioned face of the applicator with an optimum dose of substance.

Such dispenser means of the substance are capable of rotating in a plane transversal to the opening movement, simply by the applicator rubbing against them in their displacement, by means of the guides, over the interior of the cover, passing the appropriate quantity of conditioning substance to the external face of the applicator.

In a preferred embodiment of the invention, the dispenser means can consist of a ball of the roll-on type coupled on a lip provided on the interior face of the cover, preferably manufactured in plastic, on the substance reservoir which is located in said cover. Inside the reservoir, as an independent piece or integrated in the bottom thereof, some elastic means are foreseen, such as a spring, which push the ball toward the lip of the closing cover, to assure the seal while the device remains open or closed, that is, when the transversal displacement of opening the device is not being carried out.

A dispensation of the conditioning substance can be carried out similarly with rollers, instead of a ball, which rotate causing the substance to leave the reservoir on passing over the applicator and transferring it to its external face for the ensuing application to the surface of the shoe.

Thus an advantage of the device which is disclosed resides in that the user always receives the same quantity of substance, the precise dose for normally cleaning a pair of shoes, in the applicator. When more is needed, the user has to re-dose substance on the applicator by means of the dispenser means of the cover, to which end the device has to be closed and opened again according to the procedure described, sliding the applicator over the internal face of the cover.

With a view to not wasting conditioning substance, one option consists in that the closure of the device is not made in the same direction as the sliding for opening, but by coupling the applicator transversely to the cover. By closing the device in this manner, the displacement of the applicator is not caused over the interior of the cover which involves the rotation of the dispenser means nor, therefore, does substance egress from the reservoir, preventing the applicator becoming dry while awaiting a new use. The cover has a profile which favours the closing movement with the transversal coupling between applicator and cover, in addition to which, by foreseeing appropriate means of retention, it is prevented that such a movement transversal to the cover is prevented from being carried out when it is required to open the device again, requiring the applicator to be extracted from the cover in the longitudinal direction, pulling it parallel to the face with the reservoir of the substance for its impregnation.

In the embodiment of the device with roll-on ball, another possible option to prevent substance on the applicator being wasted when it is not in use is that the ball is only able to rotate when drawn by the applicator in the longitudinal direction of opening and even in only one direction: that of pulling the applicator over the interior of the cover to open the device. Similarly, in the embodiment of the device with rollers, waste of the substance can be avoided by foreseeing means to block the movement which only allow their rotation in a single direction: that of extracting the applicator longitudinally with respect to the cover.

While the device remains closed, the dispenser means are in contact with the foam but do not act because there is no movement which causes their rotation, whereby the device can be stored and used in any position, without fear of incurring loss of the substance or that the applicator become impregnated unnecessarily until it is opened for its immediate use. Contrary to what happens in other known footwear cleaners, it is not necessary that the device be vertical to apply the substance or to store it sure that no leaks will take place into the applicator.

To minimize the possible substance leakage when closing the device, its applicator is provided with a cavity in correspondence with the dispenser means so that, on covering the external face of such applicator with the cover when closing the device, the cavity of the applicator receives said dispenser means in the coupling with the cover, allowing a substantial reduction in the pressure of the applicator on the same, whereby no substance dispensation is caused even when the device is completely closed.

Consequently, another essential advantage of the device is that it offers a guarantee of cleanliness when it is used properly, apart from the ease and convenience which its use implies.

Additionally, the actual aesthetic configuration of the applicator, the external face of which constitutes an extensive surface for polishing a shoe easily, which moreover is finished in a tapered part, allows all the areas of the footwear it is desired to clean to be reached without difficulty.

DESCRIPTION OF THE DRAWINGS

To complete the description that is being made and with the object of assisting in a better understanding of the characteristics of the invention, in accordance with a preferred example of practical embodiment thereof, accompanying said description as an integral part thereof, is a set of drawings wherein, by way of illustration and not restrictively, the following has been represented.

PREFERRED EMBODIMENT OF THE INVENTION

In the light of the aforesaid figures, a device for the care of footwear can be described as a possible embodiment of the invention which is constituted by an ergonomic handle (1), designed with a geometry which allows the user to manage the device comfortably, incorporating a soft applicator (2), preferably manufactured in polyurethane foam, in the base of said ergonomic handle (1), to be able to clean, polish or dye any area of the surface of the footwear while managing the device with only one hand.

Figure 1:
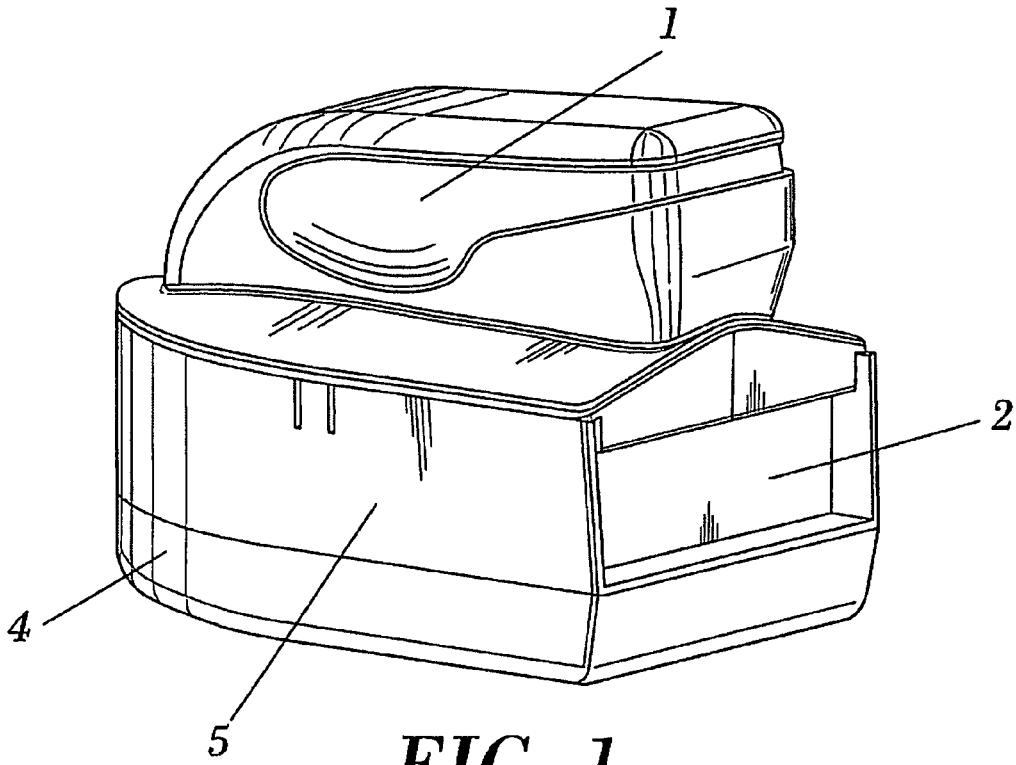
FIG. 1.—It shows a view in perspective from the rear of the device for the care of footwear which is disclosed, located in the horizontal position, it being possible to observe the applicator element.
Figure 2:
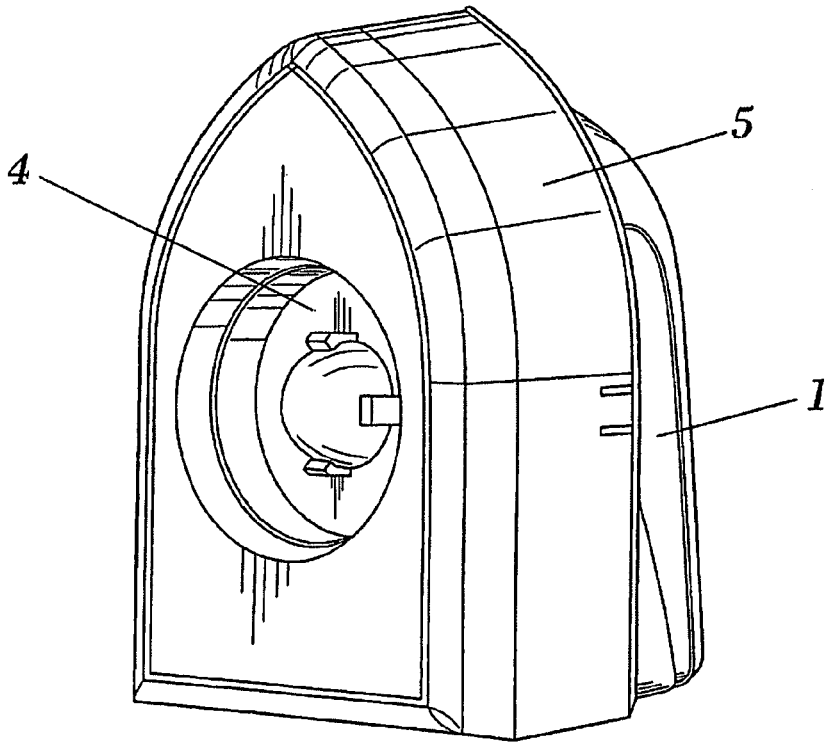
FIG. 2.—It shows a view in perspective from below the device for the care of footwear, located in the vertical position to show the substance reservoir included in the cover.

The sponge or foam applicator (2), preferably heat-bonded by one face to the base of the handle (1), formed in plastic, has an external face (3) intended to be impregnated with an appropriate conditioning substance, which is contained in a reservoir (4) located in a cover (5) foreseen for the hermetic closure of the device, as is shown in FIGS. 1 and 2.

Figure 3:
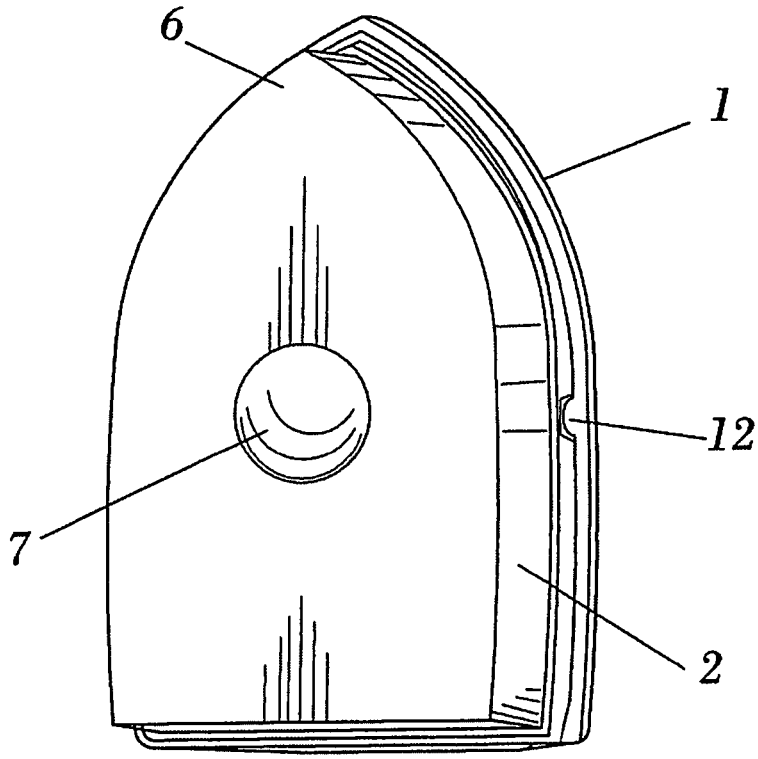
FIG. 3.—It shows a view in perspective of the applicator, illustrating the external face thereof which is that intended to be in contact with the surface of the footwear for the treatment thereof.

According to the preferred embodiment which is represented in FIG. 3, the external face (3) of the applicator (2), which is that which is in contact with the surface of the footwear when proceeding to the cleaning thereof, has a broad area in order to be able to clean large flat areas of shoes, finished in a tip (6) appropriately tapered to be able to adapt to any footwear design, in order to facilitate the cleaning of the places of most difficult access which the shoe may have.

Figure 4:
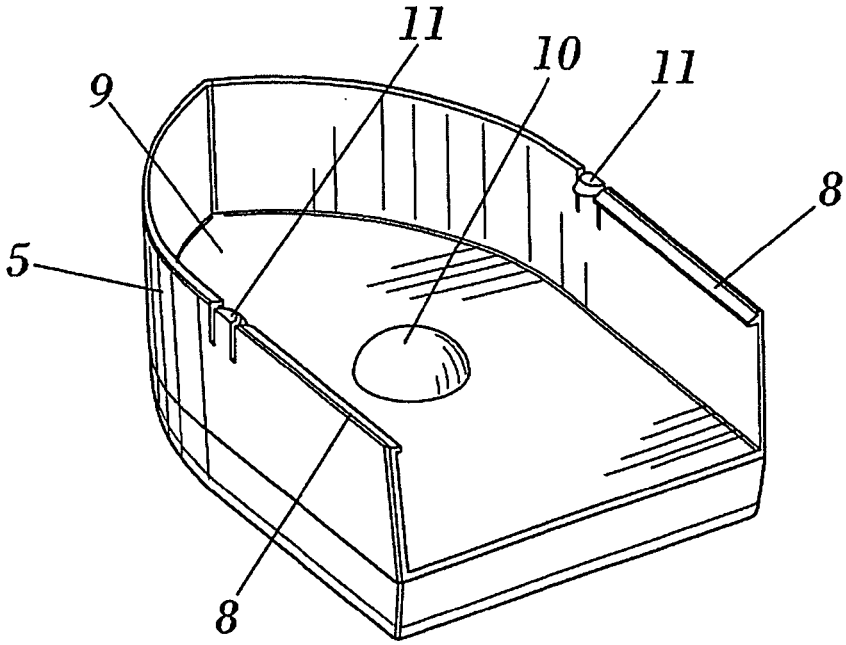
FIG. 4.—It shows a view in perspective of the cover of the device, showing on its internal face the dispenser means of footwear conditioning substance, according to a possible embodiment with roll-on ball.

The cover (5) of the device, shown in FIG. 4, has a configuration adapted in shape and size make coupling to the applicator (2) possible, being constituted as a body with a lateral face, a lateral mouth and another above, plus an internal face (9) where dispenser means (10) of the conditioning substance are incorporated. In the upper part of the lateral face of said cover (5), guides (8) are foreseen which are adjusted to the peripheral rim of the base of the handle (1) and facilitate the coupling of the unit formed by said handle (1) with the applicator (2) incorporated, allowing a displacement of the external face (3) of the applicator (2) over the internal face (9) of the cover (5).

Figure 5:
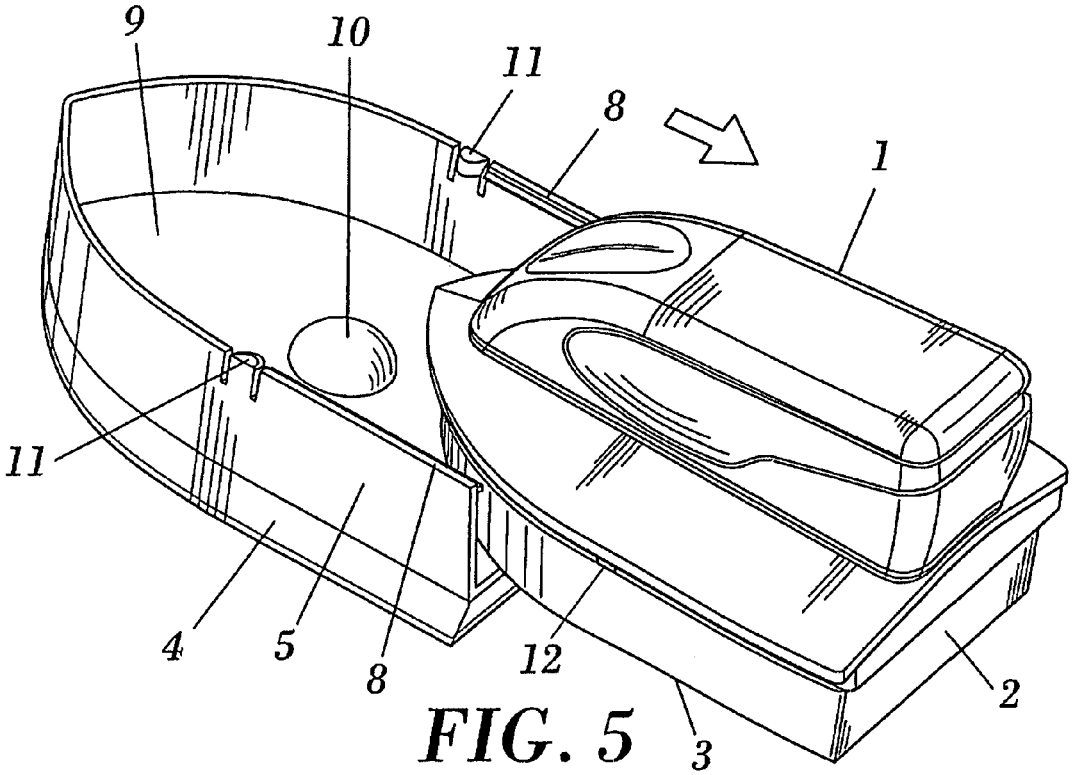
FIG. 5.—It shows a view in perspective of the applicator and cover assembly which form the device, proceeding to the opening thereof and dispensation of the conditioning substance, according to the object of the invention.

In said cover (5) is housed the reservoir (4) of conditioning substance, inside which are included dispenser means (10) of the substance which, according to one option of embodiment like that illustrated in FIGS. 4 and 5, consist of a plastic or rubber lip, whereon a ball of the roll-on type is coupled to make the seal. When the device is opened by simply moving the applicator (2) in the direction longitudinal to the cover (5), the user having gripped it by the handle (1), sliding the external face (3) of said applicator (2) over the internal face (9) of the cover (5), outwards from the guides (8) of said cover (5), as shown in FIG. 5.

Thus, when the displacement takes place of the handle (1) and applicator (2) assembly over the interior of the cover (5), the applicator (2) makes the dispenser means (10) housed in said cover (5) rotate by friction, causing the dosing of the conditioning substance conveniently on such applicator (2), by pushing the roll-on ball downwards in its travel, which rotating movement causes the substance to egress from the reservoir (4) and be applied directly on the external face (3) of the applicator (2).

When the applicator (2) has been transported over the full internal face (9) of the cover (5), until removing the handle (1) and applicator (2) assembly out of said cover (5), some elastic means are foreseen, such as a spring or a flexible piece which emerges from the very bottom of the reservoir (4), which push the ball again but upwards, closing the lip arranged on the internal face (9) of the cover (5) and so guaranteeing the seal.

Meanwhile, on the external face (3) of the applicator (2) the dispenser means (10) have applied the precise and necessary quantity to clean or polish a pair of shoes. Such external face (3) is provided, in one option of embodiment, in accordance with that shown in FIG. 3, with a cavity (7) in correspondence with the disposition of the dispenser means (10) of the device, so that the pressure of the applicator (2) on said dispenser means (10) is minimum when the device is closed, thereby reducing the possibility that, if it is not being used, footwear conditioning substance escapes.

Figure 6:
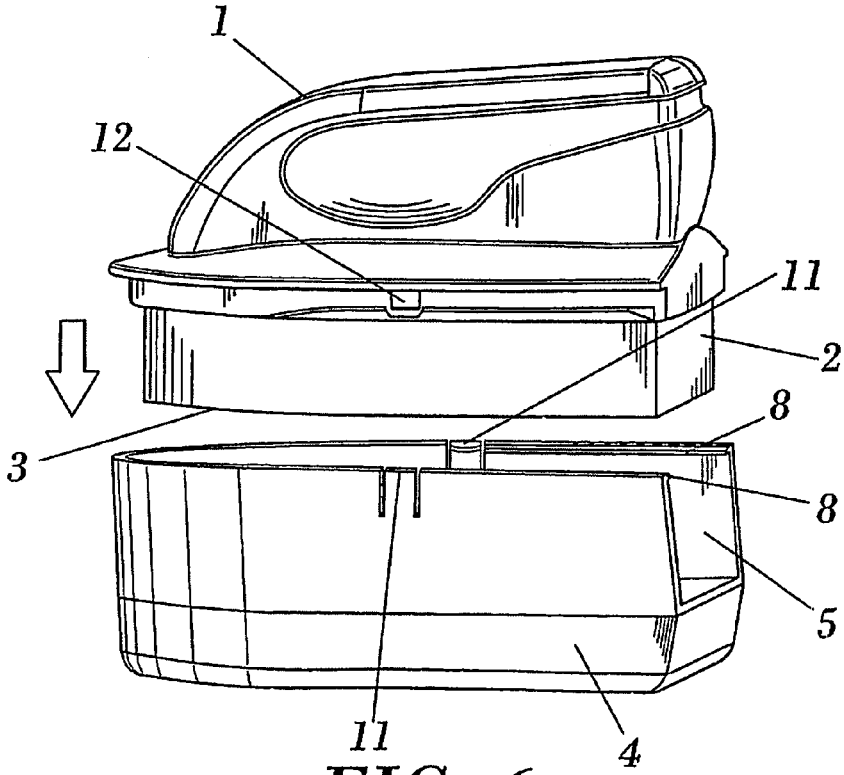
FIG. 6.—It shows a view in perspective of the applicator and cover assembly which form the device, in the ready for closing state after its use.

Subsequently, when the care of the footwear has concluded or if another dosing of the substance is needed to treat more shoes, the user must close the device again, putting the applicator (2) inside the cover (5) so that it is charged with more substance dosed by the dispenser means (10) from the reservoir (4). However, the closing of the device is not carried out in the same direction as its opening, but instead it is carried out transversely to the cover (5), as shown in FIG. 6, which impedes that on closing it the applicator (2) makes said dispenser means (10) rotate and causes the dosing of conditioning substance before it is opened again, avoiding that the substance be wasted. To achieve this closing in the transversal direction, confronting the external face (3) of the applicator (2) with the internal face (9) of the cover (5), the lateral face of the cover (5) is provided with a profile which favours the engagement between the handle (1) and said cover (5), introducing the applicator (2) through the upper mouth of said cover (5). In the embodiment which is shown in FIGS. 5 and 6, the profile of the cover (5) additionally incorporates some tabs (11) which are coupled in some grooves (12) foreseen on the periphery of the handle (1), for retention between the handle (1) and the cover (5), assuring the closure.

Figure 7:
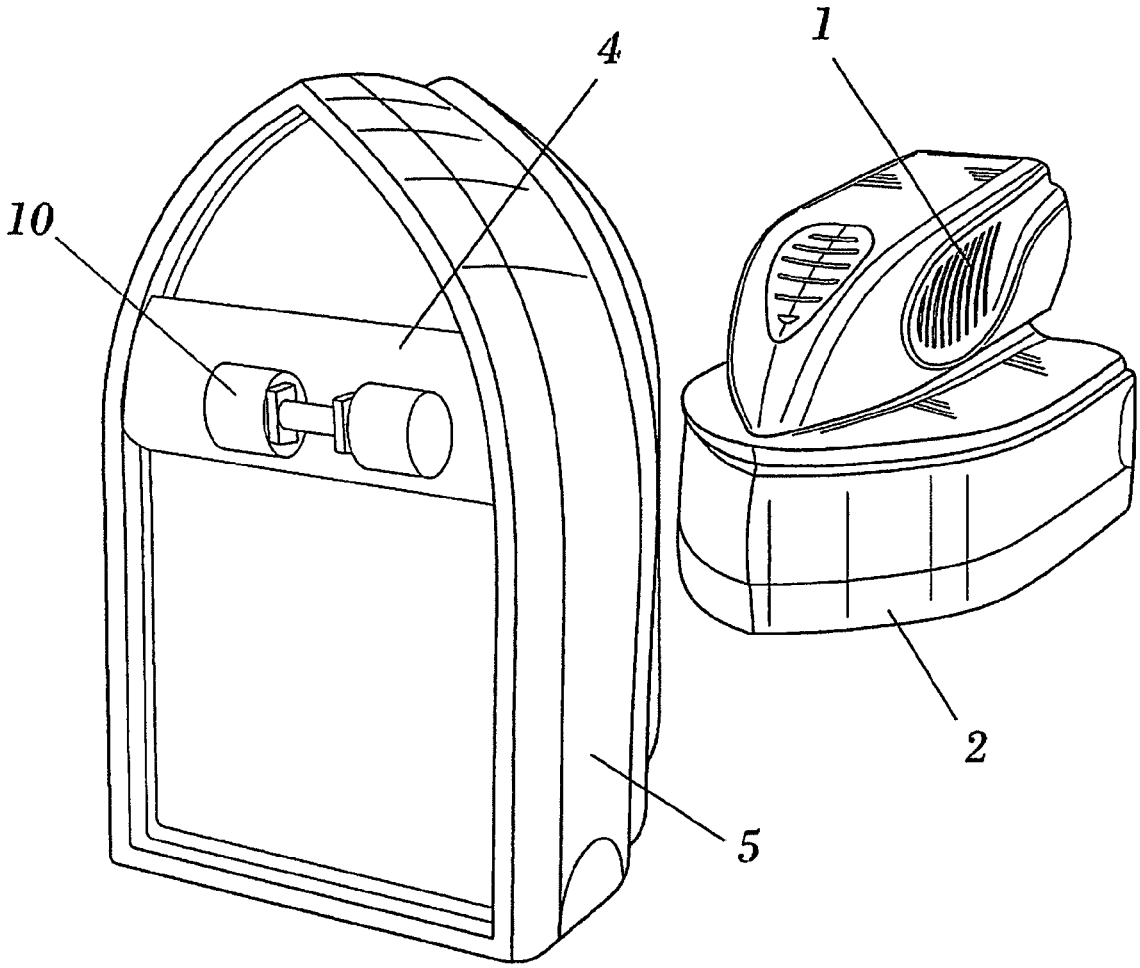
FIG. 7.—It shows a view in perspective of the cover of the device, showing on its internal face the dispenser means of conditioning substance, according to another alternative embodiment with rollers.

The same operation is achieved in the alternative embodiment of the invention shown in FIG. 7, wherein the dispenser means (10) of the cleaning and polishing substance for shoes consist of rollers which in their rotation apply the substance to the applicator (2) on opening the device as previously explained, from any position, vertical, horizontal or inclined, but in the longitudinal direction marked by the guides (8) of the cover (5).

The reservoir (4) incorporated in said cover (5) is made of transparent plastic, at least partly, to allow the user to see, even with the device closed, the amount of substance remaining in the reservoir (4) and to appreciate when it has finished.

Although initially the device is conceived to be used and disposed of when the conditioning substance is finished, it is also foreseen that it can be reusable by introducing a new cartridge of liquid or cream, appropriate for the treatment of footwear, inside the reservoir (4), locating it under the ball or the roller that serve as dispenser means (10), for which purpose the reservoir (4) is equipped with an external cover which allows easy access for the user to carry out substance replacement when necessary.

The invention claimed is:

1. Device for the care of footwear, which device comprises:

an applicator (2) having an external surface (3) suitable for applying a conditioning substance on a surface of a shoe; and a cover (5) comprising a reservoir (4) containing a conditioning substance for conditioning the footwear and also comprising rotating dispenser means (10) provided on a surface (9) of said cover (5), wherein said dispenser means is configured to be impregnated with said substance upon rotation of the dispenser means in said surface (9), and wherein the applicator (2) and the cover (5) are configured to be detachably coupled in such a manner that opening displacement of the applicator (2) from the cover (5) causes the dispenser means (10) to rotate and to apply a dose of said substance on the external surface (3) of the applicator (2).

2. Device for the care of footwear, according to claim 1, wherein the dispenser means (10) consists of rollers impregnable with the substance contained in the reservoir (4) and the rollers are capable of rotating upon sliding external face (3) of the applicator (2) over an interior of the cover (5).

3. Device for the care of footwear, according to claim 1, wherein the dispenser means (10) consists of a ball impregnable with the substance contained in the reservoir (4), which ball is capable of rotating upon sliding external face (3) of the applicator (2) over an interior of the cover (5).

4. Device for the care of footwear, according to claim 1, wherein the dispenser means (10) is adapted to rotate in only one direction.

5. Device for the care of footwear, according to claim 1, wherein the applicator (2) is configured to be coupled transversely to the cover (5).

6. Device for the care of footwear, according to claim 1, wherein the applicator (2) is comprised of a soft material.

7. Device for the care of footwear, according to claim 1, wherein external face (3) of the applicator (2) is finished in a tapered surface (6) which adapts to clean any area of the surface of the footwear.

8. Device for the care of footwear, according to claim 1, wherein the external face (3) of the applicator (2) has a cavity (7) in correspondence with the dispenser means (10).

9. Device for the care of footwear, according to claim 1, wherein the device incorporates a handle (1) joined by its base with the applicator (2).

10. Device for the care of footwear, according to claim 9, wherein the handle (1) is ergonomic.

11. Device for the care of footwear, according to claim 9, wherein the cover (5) has, on an upper part of its lateral face, guides (8) whereon a peripheral rim of the handle (1) is coupled, which guides allow longitudinal sliding of the applicator (2) over an interior of said cover (5) until its extraction to open the device.

12. Device for the care of footwear, according to claim 9, wherein the cover (5) has, on an upper part of its lateral face, tabs (11) which are coupled in grooves (12) foreseen on the peripheral rim of the base of the handle (1).

13. Device for the care of footwear, according to claim 1, wherein the reservoir (4) is at least partially transparent.

14. Device for the care of footwear, according to claim 1, wherein the reservoir (4) has an access through which a conditioning substance replacement is introduced.

15. Device for the care of footwear, according to claim 1, wherein the reservoir (4) is removable from the cover (5).

* * * * *